US006213138B1

(12) United States Patent
Wimpee

(10) Patent No.: US 6,213,138 B1
(45) Date of Patent: Apr. 10, 2001

(54) TENT FRAME

(76) Inventor: Ronald Lee Wimpee, 104 Cedarwood, Sherwood, AR (US) 72120

( * ) Notice: Subject to any disclaimer, the term of this patent is extended or adjusted under 35 U.S.C. 154(b) by 0 days.

(21) Appl. No.: 09/167,739

(22) Filed: Oct. 7, 1998

(51) Int. Cl.[7] ..... E04H 15/34
(52) U.S. Cl. ..... 135/121; 135/156; 135/157
(58) Field of Search ..... 135/119, 121, 135/156, 157, 907, 141, 142; 52/86

(56) References Cited

U.S. PATENT DOCUMENTS 3,957,069 5/1976 Senaro ..... 135/119
4,921,369 5/1990 Chew ..... 135/98
5,598,668 2/1997 Isom ..... 135/118

*Primary Examiner*—Beth A. Stephan
(74) *Attorney, Agent, or Firm*—John P. Halvonik

(57) ABSTRACT

An improved tent frame apparatus comprising a rectangular tubular network having primarily four corner sections of tubular shape. Each of the corner pieces has a threaded hook and nut arrangement in connection with the corner in order to tightly stretch a tent flap that is connected to the hook and nut arrangement. In this manner, a tent flap having an eyelet may be connected to the hook and nut and then be tightly stretched in order to connect the tent to the frame structure by means of the tent flaps.

3 Claims, 1 Drawing Sheet

FIG. 1
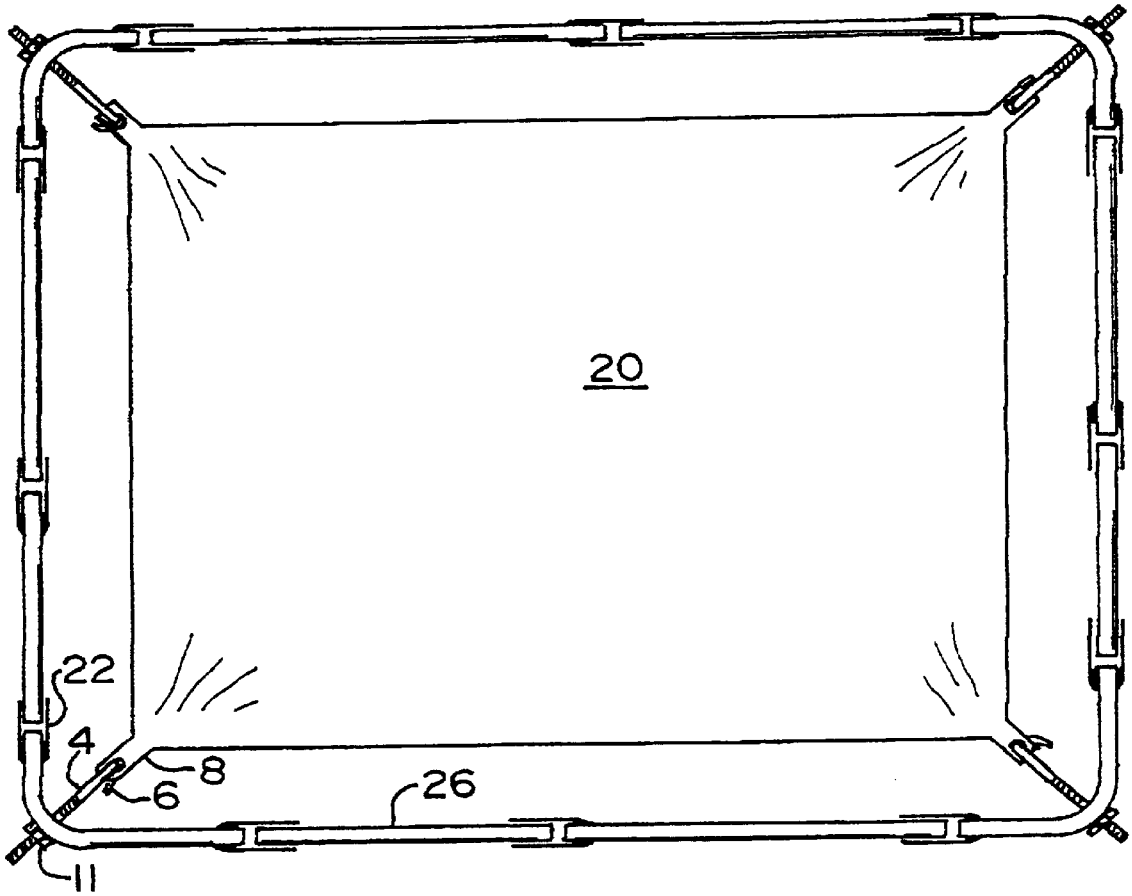
FIG. 2
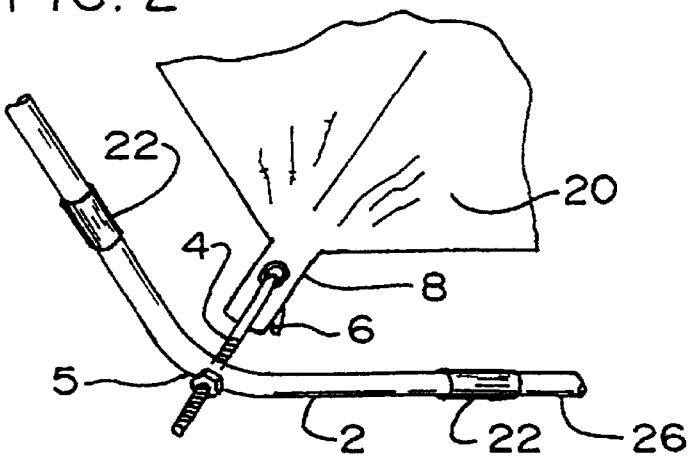
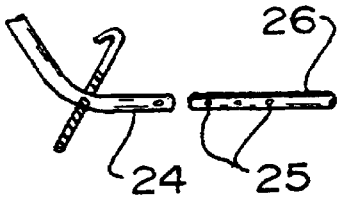
FIG. 3

TENT FRAME

FIELD AND BACKGROUND OF THE INVENTION

The invention relates to the field of camping and hunting and related devices and in particular to a novel tent frame support system. In particular, the invention comprises a novel tent frame that is of square or rectangular frame for securing the four tent flaps in the corner of the tent to each of the four corners of the tent frame so as to provide a self supporting framework that replaces the needs to use tent stakes.

The use of the rectangular framework and suitable connecting means at the corners allows for the tent structure to be used without the need for tent stakes or similar devices that must be driven into the soil in order to secure a tent. The framework of the present invention includes the use of threaded hooks at the corner of the frame that allow the framework to be attached to existing tent flaps by use of hooks that are securing the existing eyelets in the tent flaps. Other tent supports, such as those that go inside the tent may also be used to support the tent in an upright manner.

It is believed that the tent framework described herein will find particular utility for pitching tents in places where it would normally be harder to use tent stakes. Such places include those areas where the soil is very sandy which means that tent stake are unlikely to be secured by pounding into the ground. Other ground may be of such nature that a tent stake may be difficult to remove once it has been placed in the ground.

It may also find utility in such areas as concrete or asphalt where tent stakes cannot in fact be used. Some areas may not be a completely hard surface, such as along a walkway or a parking lot, but the soft ground areas are so situated as to make the use of tent stakes very difficult.

Such use of a tent frame is believed to be useful for such activities as flea markets, trade shows, swap meets or sidewalk vendors where typically vendors may want to set up tents upon a hard surface but do not have enough soft ground in order to adequately use tent stakes.

PRIOR ART

While there are tent frames known to the prior art, there are no known tent frame that are of the applicant's unique construction including the use of a threaded hook and nut arrangement for linking the holes in the tent flaps to an appropriate corner of the tent frames.

SUMMARY OF THE INVENTION

An improved tent frame apparatus comprising: a rectangular tubular network having four corner sections of tubular shape and a series of adjustment pieces for intermediate adjustable connections between these corner pieces. Each of the pieces are of tubular shape and have ends that are crimped or otherwise adapted to fit within the ends of one another. The adjustment pieces having a series of spaced apart apertures in order to vary the effective distance of the side of the tent frame and so accommodate different sized tents.

Each of the corner pieces has a threaded hook and nut arrangement in connection with it in order to tightly stretch a tent flap that is connected to the hook and nut arrangement. In this manner, a tent flap having an eyelet may be connected to the hook and nut and then be tightly stretched in order to connect the tent to the frame structure by means of the tent flaps.

It is an object to provide a tent frame structure that can be quickly set up with a minimum of time and effort and without having to use tent stakes.

It is another object to provide a tent frame structure that dispenses with the need to use tent stakes in order to provide a tent support on a hard surface.

Other objectives will be apparent to those skilled in the art once the invention is shown and described.

DESCRIPTION OF FIGURES

FIG. 1 plan view of overall tent and frame structure;

FIG. 2 detail of threaded hook and tent flap connection;

FIG. 3 optional extension piece.

DESCRIPTION OF PREFERRED EMBODIMENT

The overall construction of the tent frame is as shown in FIG. 1. There are at least four tubular sections 2 that are used. Each of these four sections should have a corner or mid point section 5 that forms a 90° bend in the tubular member. This shape allows the sections to form a rectangular structure when the four sections are joined to one another. The ends of each section may be made of slightly differing diameters so that they can be frictionally fitted into one another so that the sections may be joined.

At each corner of a member is a threaded hook and nut arrangement which is used to connect the corner of the tent frame to a tent flap. A threaded rod 4 fits within an aperture in the midpoint 5. The aperture forms a frictional connection with the threaded rod so that the rod may be rotated within the aperture and so vary the distance it extends from the member and toward the tent flap. The hook is shown as 6, it is at the end of the rod and is sized so that it can engage the eyelet in the standard tent flap 8. The nut 11 at the end of the rod is used to tighten the rod into place once the proper distance of the rod has been chosen. The nut should not be tightened until the eyelet in the tent flap is engaged with the hook, at which time the rod may be adjusted in length from the tube so as to put tension on the flap. The nut may then be used to tighten the rod into it's proper place.

In addition to the four corner sections of the tent frame, there may be additional adjustment sections 26 that are used to add length to each of the sides of the tent. Both these sections and the corner sections should have ends that are made with state of the art crimping or swelling so that one section may be slightly narrower or slightly larger in diameters so that these sections may be interfitted within one another and frictionally held together. In which case the ends of each section that are to fit within one another should be made of slightly differing diameters so that one section may fit within the other.

The adjustment sections 26 may be used as an option and in order to add length to the sides of the tent frame. As the tent frame is generally rectangular, these sections will no doubt be used in pairs, with each pair being used on opposite sides of the tent frame. Each adjustment section should have a series of apertures that are spaced at predetermined intervals, see FIG. 3. Each end of the corner section should have at least one aperture 24 that corresponds to these apertures so that the ends of the corner sections may be joined to the adjustment sections by placing a pin or similar mechanical means into both the hole in the end of the corner piece and the adjustment piece. A given adjustment section would be in connection with two corner pieces in this manner.

The apertures in the adjustment pieces should be at predetermined intervals, say one inch, so that adjustments can be made by regular intervals in the length of a given pair of opposite sides of the tent frame. See FIG. 3. It is preferred that each of the adjustment sections be about 3–4' in length and there may be, for example, 3 or 4 holes (shown as 25 in FIG. 3) in at least one of the members (corner section or extension section). The corner section may have one aperture (shown as 24 in FIG. 3).

An optional collar 22 may also be used in connection with the pieces to offer an additional method of joining the sections. The collar is slightly larger in diameter than the tubular sections but can join each section and so connect the various sections.

The invention uses the existing tent flaps that have an aperture or eyelet in them to connect to the four corners of the framework by means of a threaded hook. Most such tents 20 come with tent flaps 8 that are designed to be used in connection with tent stakes. These commonly used tent flaps are typically about 6–10" or more in length and most of them come with an eyelet or some other sort of aperture that allows a tent stake to be driven through the eyelet in order to secure the tent flap to the ground by means of stakes that are inserted through the eyelet.

Detail of the threaded nut and hook arrangement is shown in FIG. 2. There is shown a hook 6 having a threaded rod 4 having a nut 11 in connection with it. The threaded end of the rod is placed through an aperture in the tubing 2 at the corner portion 5 of the tube. The aperture in the corner member should be of such size so as to interact with the threads and so allow the threaded hook to be adjusted in terms of the distance that the hook is from the corner of the tent frame. This can be done by adjusting the hook or, in other words, by screwing the threaded hook more or less as needed in order to stretch the hook and tent flap to the maximum extent possible and so tighten the tent to the corner of the frame.

With the use of this adjustment, the tent flap and hook connection can be varied in length to accommodate for different sized tent flaps and hence allow the tent flap to be tightly connected to the corner of the tent frame with a minimum of slack in the flap.

The preferred size of the framework would be 9 feet by 9 feet which should be suitable for typical four or five man tents. The framework size may vary greatly in order to accommodate larger or smaller sized tents without varying from the spirit of the invention.

It is preferred that the frame of the present invention use tubular shaped materials and is thought that metal or plastic materials would be suitable for this invention. Other sturdy materials may be used without varying from the spirit of the invention. Polyvinyl chloride (PVC) or aluminum metal are two materials that come readily to mind in terms of suitable materials.

Additional means, not shown, may be used in connection with the frame in order to keep it close to the ground in the event of high winds, etc. Weights and other such items may be used in connection with the frame to provide additional weight and so keep it in place in the event of a storm.

For purposes of this discussion, the term "rectangular" refers to a tent frame having four sides and having right angles at each of the corners of the tent frame. Such term may include a square shaped frame.

I claim:

1. An improved tent frame for use with tent coverings having flaps, each of the flaps having a flap aperture in them, said tent frame comprising: at least four tubular pieces, each of said pieces having a mid point and each piece having a 90° angle at about the mid point; each said piece having an aperture at about said mid point, at least four threaded bolts in association with each of said tubular pieces and being adapted for rotatable connection with said apertures so that said bolts may be rotated within said apertures in order to vary the distance that said bolt may extend from said aperture, each of said bolts having an end, said end having a hook shaped section adapted for engagement with said flap apertures.

2. The apparatus of claim 1 wherein each of said tubular pieces has a pair of ends that are of dissimilar diameter; said disimilar ends adapted to frictionally engage with one another.

3. The apparatus of claim 2 wherein at least two of said tubular pieces have means to vary the length of said tubular pieces so as to provide for adjustment of the effective length of said tubular pieces.

* * * * *